US011339014B2

(12) United States Patent
Nakamura

(10) Patent No.: US 11,339,014 B2
(45) Date of Patent: May 24, 2022

(54) ATTACHMENT, FEED DEVICE, AND IMAGE FORMING APPARATUS

(71) Applicant: Mitsutaka Nakamura, Kanagawa (JP)

(72) Inventor: Mitsutaka Nakamura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/027,807

(22) Filed: Sep. 22, 2020

(65) Prior Publication Data

US 2021/0122593 A1 Apr. 29, 2021

(30) Foreign Application Priority Data

Oct. 23, 2019 (JP) ..... JP2019-192717

(51) Int. Cl.

*B65H 1/04* (2006.01)
*B65H 1/26* (2006.01)
*B41J 11/00* (2006.01)

(52) U.S. Cl.

CPC ..... *B65H 1/266* (2013.01); *B41J 11/0055* (2013.01); *B65H 2404/71* (2013.01); *B65H 2801/03* (2013.01)

(58) Field of Classification Search

CPC . B65H 1/266; B65H 1/04; B65H 1/12; B65H 2404/71; B65H 2511/11; B65H 2801/03
See application file for complete search history.

(56) References Cited

U.S. PATENT DOCUMENTS 6,409,165 B1 * 6/2002 Yamaoka ..... B65H 1/12 271/127
7,967,287 B2 * 6/2011 Hamasaki ..... B65H 1/266 271/171
9,260,262 B2 * 2/2016 Matsumoto ..... B65H 1/04
2007/0189822 A1 8/2007 Nakamura
2010/0221051 A1 * 9/2010 Yamazaki ..... G03G 15/6511 399/400
2011/0210501 A1 * 9/2011 Shiokawa ..... B65H 1/266 271/241
2015/0102550 A1 4/2015 Hirata et al.
2017/0349390 A1 12/2017 Nakamura et al.
2019/0135560 A1 5/2019 Nakamura et al.

FOREIGN PATENT DOCUMENTS

JP 03042423 A * 2/1991
JP 08324804 A * 12/1996
JP H11-059925 3/1999
JP 2017-218235 12/2017

* cited by examiner

*Primary Examiner* — Luis A Gonzalez
(74) *Attorney, Agent, or Firm* — Harness, Dickey & Pierce, P.L.C.

(57) ABSTRACT

An attachment is attachable to and detachable from a sheet stacking board. The attachment includes an end fence configured to restrict a position of a trailing end of a sheet in a conveying direction. The end fence includes a facing surface facing the trailing end of the sheet. The facing surface includes an inclined surface inclined with respect to a vertical direction of a stacking surface on which the sheet is stacked, such that a higher part of the facing surface is located more upstream in the sheet conveying direction.

9 Claims, 14 Drawing Sheets

ATTACHMENT, FEED DEVICE, AND IMAGE FORMING APPARATUS

CROSS-REFERENCE TO RELATED APPLICATIONS

The present application claims priority under 35 U.S.C. § 119 to Japanese Patent Application No. 2019-192717, filed on Oct. 23, 2019. The contents of which are incorporated herein by reference in their entirety.

BACKGROUND OF THE INVENTION

1. Field of the Invention

The present invention relates to an attachment, a feed device, and an image forming apparatus.

2. Description of the Related Art

Conventionally, an attachment that is attachable to and detachable from a sheet placing board has been known.

A feed apparatus with respect to which the attachment as described above is attachable and detachable is described in Japanese Unexamined Patent Application Publication No. 2017-218235. In Japanese Unexamined Patent Application Publication No. 2017-218235, when a special sheet, such as an envelope with a flap, is to be conveyed, the attachment is attached to a sheet stacking board of a feed tray, and the special sheet is stacked on and fed from the attachment.

However, there is a risk that sheet setting performance of the attachment will be reduced.

SUMMARY OF THE INVENTION

According to an aspect of the present invention, an attachment is attachable to and detachable from a sheet stacking board. The attachment includes an end fence configured to restrict a position of a trailing end of a sheet in a conveying direction. The end fence includes a facing surface facing the trailing end of the sheet. The facing surface includes an inclined surface inclined with respect to a vertical direction of a stacking surface on which the sheet is stacked, such that a higher part of the facing surface is located more upstream in the sheet conveying direction.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
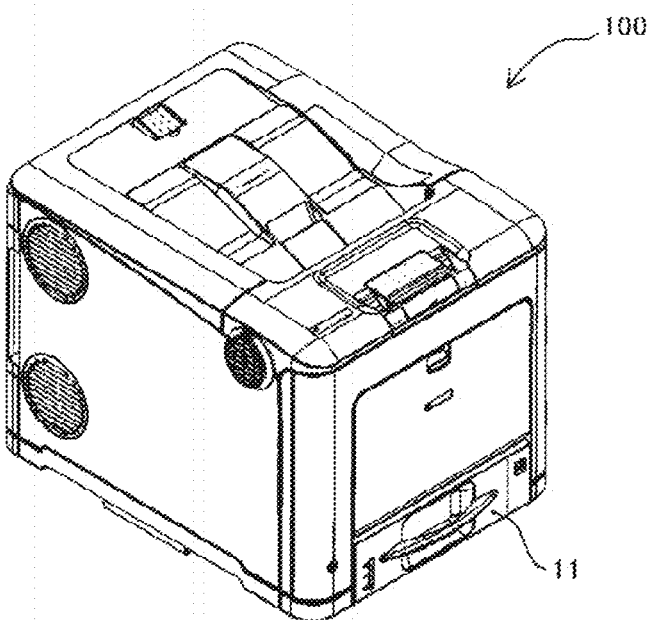
FIG. 1 is an explanatory perspective view of a printer according to an embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

Hereinafter, as an image forming apparatus according to the present invention, an electrophotographic printer (hereinafter, simply referred to as a printer) that forms an image by an electrophotographic system will be described. In the present embodiment, a color laser printer will be described as one example of the image forming apparatus, but the image forming apparatus need not always be of a color type, but may be of a monochrome type. Further, the color laser printer is not limited to a printer, but may be a different image forming apparatus, such as a copier or a multifunction peripheral.

First, a basic configuration of the printer according to the embodiment will be described. FIG. 1 is an explanatory perspective view of a printer 100 according to the embodiment, and FIG. 2 is a schematic configuration diagram of the printer 100.

The printer 100 includes a sheet feed device 70 that is a sheet material feed device, under an image forming unit 60 that is an image forming means.

Figure 2:
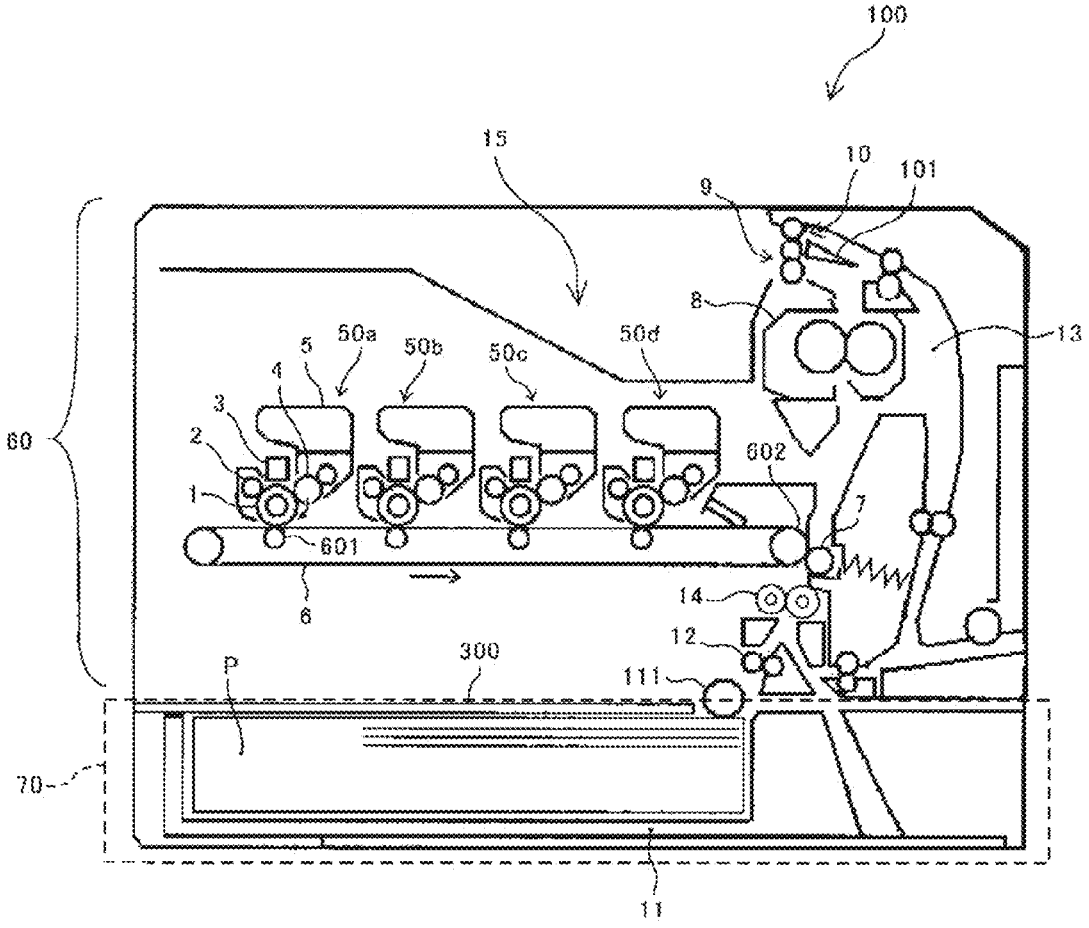
FIG. 2 is a schematic configuration diagram of the printer.

As illustrated in FIG. 2, the image forming unit 60 includes an intermediate transfer belt 6 that is an intermediate transfer member. A surface of the intermediate transfer belt 6 moves so as to rotate in a counterclockwise direction in FIG. 2 as indicated by an arrow in FIG. 2. Four image forming units 50 (a to d) are arranged above the intermediate transfer belt 6 along a surface movement direction of the intermediate transfer belt 6. The four image forming units 50 (a to d) respectively form single color images using toner of black, magenta, cyan, and yellow, and have the same configurations except for the colors of toner to be used.

Each of the image forming units 50 includes a photoconductor 1 that is a rotatable latent image bearer, a charging device 2 that uniformly charges a surface of the photoconductor 1, and a light emitting diode (LED) 3 as a light source that applies laser light to the uniformly charged surface of the photoconductor 1 and forms an electrostatic latent image. Further, the image forming unit 50 includes a developing device 4 that develops the electrostatic latent image by supplying toner to the surface of the photoconductor 1 on which the electrostatic latent image is formed and forms a toner image on the surface of the photoconductor 1, and a developer cartridge 5 that stores therein developer to be supplied to the developing device 4.

A primary transfer roller 601 is arranged at a position facing the photoconductor 1 and inside the intermediate transfer belt 6. In a primary transfer nip in which the primary transfer roller 601 and the photoconductor 1 sandwich the intermediate transfer belt 6, the toner image formed on the photoconductor 1 is primarily transferred onto the intermediate transfer belt 6. The toner images formed on the four photoconductors 1 are sequentially transferred onto the intermediate transfer belt 6 in a superimposed manner, so that a color toner image is formed on the surface of the intermediate transfer belt 6.

A secondary transfer roller 7 that transfers the toner image formed on the surface of the intermediate transfer belt 6 to a sheet P (recording medium) that is a sheet material is arranged on the right of the intermediate transfer belt 6 in FIG. 2. A secondary transfer opposing roller 602 is arranged at a position facing the secondary transfer roller 7 and inside the intermediate transfer belt 6, and a secondary transfer nip is formed in which the secondary transfer opposing roller 602 and the secondary transfer roller 7 sandwich the intermediate transfer belt 6. In the secondary transfer nip, the toner image formed on the intermediate transfer belt 6 is secondarily transferred onto the sheet P.

As illustrated in FIG. 2, the sheet feed device 70 includes a sheet cassette 11 in which the sheets P are stacked, and the sheet cassette 11 is drawable from an apparatus main body of the printer 100.

Further, the sheet feed device 70 includes a sheet feed roller 111 that separates and feeds only the uppermost sheet in a bundle of the sheets P in the sheet cassette 11, and delivers the sheet P to a sheet feed conveying roller pair 12 that is located downstream in a sheet feed direction.

A registration roller pair 14 is arranged above the sheet feed conveying roller pair 12 in the image forming unit 60. The registration roller pair 14 temporarily causes the sheet fed from the sheet feed device 70 to be slack, and delivers the sheet P to the downstream secondary transfer nip in accordance with a transfer timing.

The image forming unit 60 includes a fixing device 8 that is arranged above the secondary transfer nip and that causes the toner image transferred on the sheet P to be fixed on the sheet P, and further includes a sheet ejection device 9 that is arranged above the fixing device 8 and that ejects the sheet P on which the toner image is fixed to the outside of the printer 100. An upper exterior surface of the image forming unit 60 serves as a sheet stacking unit 15 for stacking the sheet P that is ejected by the sheet ejection device 9.

A reversing device 10 that guides the sheet P, in which an image is formed on one side, toward a duplex conveying path 13 at the time of duplex printing is arranged above the sheet ejection device 9. Further, a separator 101 is provided that switches between the sheet ejection device 9 and the reversing device 10 as a conveying destination of the sheet P that has passed through the fixing device 8. Furthermore, the duplex conveying path 13 that coveys the sheet P, in which the image is formed on one side and which is conveyed from the reversing device 10 at the time of duplex printing, toward the registration roller pair 14 is arranged on the right of the fixing device 8 in the image forming unit 60 in FIG. 2.

The sheet feed device 70 of the printer 100 of the present embodiment includes, as illustrated in FIG. 2, a sheet material top surface guide plate 300 that is arranged so as to be located above the sheet materials stored in the sheet cassette 11 and that restricts upward movement of the sheet materials.

Figure 3:
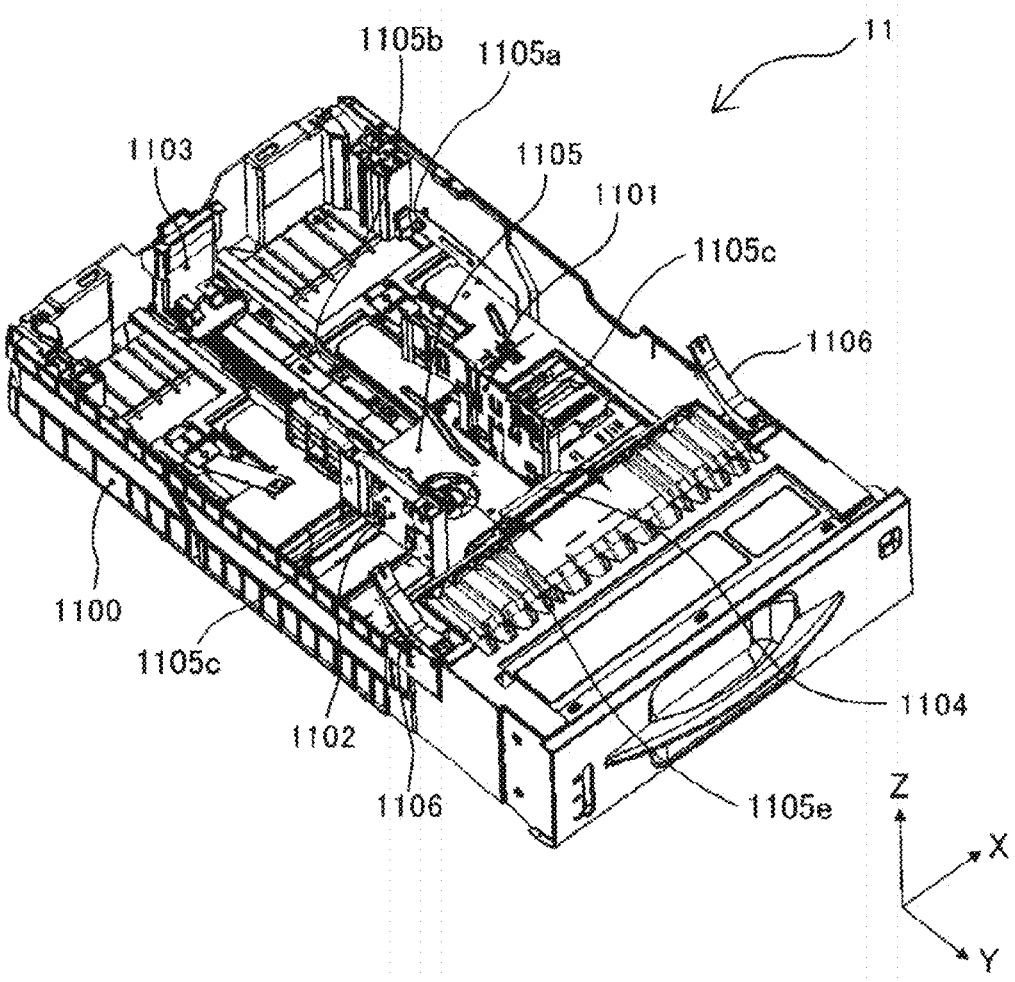
FIG. 3 is an explanatory perspective view of a sheet cassette.

FIG. 3 is an explanatory perspective view of the sheet cassette 11 that is a feed tray.

The sheet cassette 11 includes a cassette housing 1100 that has a box shape with open top and that forms a space for housing the sheets P. Further, the sheet cassette 11 includes a first side fence 1101 and a second side fence 1102 that are movable in a width direction (X direction in FIG. 3) with respect to the cassette housing 1100 and that restrict a width-directional position of the sheet P set in the sheet cassette 11. Furthermore, the sheet cassette 11 includes an end fence 1103 that is movable in a direction parallel to a sheet feed direction (Y direction in FIG. 3) with respect to the cassette housing 1100 and that restricts an upstream end position of the sheet P in the sheet feed direction when the sheet P is set in the sheet cassette 11.

The two side fences 1101 and 1102 are configured so as to be slidable in the width direction (X direction) in conjunction with each other with use of a moving mechanism that is configured with a rack and pinion. Specifically, a rack is arranged on each of the side fences 1101 and 1102. The racks are engaged with a pinion so as to sandwich the pinion from both ends, where the pinion is arranged in approximately the center in a sheet width direction. With this configuration, if one of the side fences is moved in the sheet width direction, the rack of the subject side fence moves in the sheet width direction in conjunction with the movement of the side fence, so that the pinion is rotated. With the rotation of the pinion, the other rack moves in an opposite direction along the sheet width direction, so that the other side fence moves in the sheet width direction in conjunction with the movement of the rack.

Furthermore, the sheet cassette 11 includes a bottom plate 1105 as a sheet placing board that is configured such that a downstream end thereof in the sheet feed direction is movable in upward and downward directions, and a configuration for engagement with a link 1106 of the apparatus main body serves as a mechanism that allows the downstream end of the bottom plate 1105 in the sheet feed direction to move upward in conjunction with upward movement of the link 1106.

A separation pad 1104 is arranged downstream of the space of the sheet cassette 11, in which the sheets P are housed, in the sheet feed direction. The separation pad 1104 sandwiches a sheet P in a space formed with the sheet feed roller 111, prevents, with use of a frictional force on the surface, the sheet P that is in contact with the separation pad 1104 from being conveyed downstream in the sheet feed direction, and separates, from other sheets P, the sheet P to which a conveying force is applied by the sheet feed roller 111 by rotating the sheet feed roller 111. With this configuration, the sheet feed roller 111 is able to separate only a single sheet P at the top of the bundle of the sheets P set in the sheet cassette 11 and convey the separated sheet P.

Figure 4:
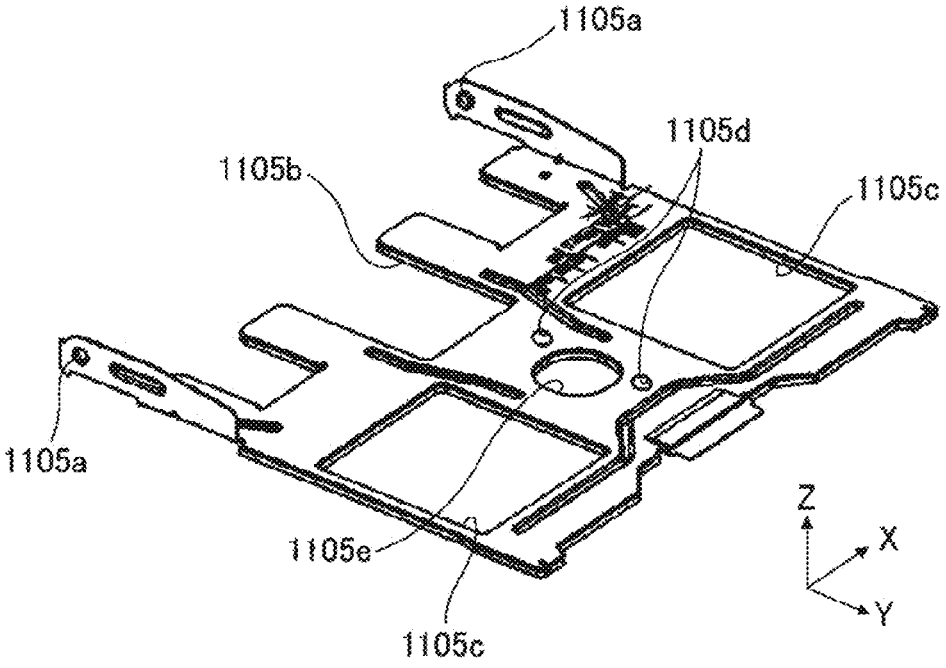
FIG. 4 is a perspective view of a bottom plate.

FIG. 4 is a perspective view of the bottom plate.

Support holes 1105*a* that are rotatably supported on side walls of the cassette housing 1100 in the width direction are arranged on downstream end portions of the bottom plate 1105 in the sheet feed direction. Further, an end fence escaping gutter 1105*b* that allows the end fence 1103 to escape and rectangular side fence escaping holes 1105*c* that allow the side fences 1101 and 1102 to escape are arranged on the bottom plate 1105. Furthermore, a circular pinion escaping hole 1105*e* that allows the pinion of the above-described moving mechanism is arranged in the center of the bottom plate in the width direction. Moreover, two attachment attaching holes 1105*d* for attaching an attachment 200 (to be described later) are arranged on the bottom plate 1105 across the pinion escaping hole 1105*e* in the feed direction.

Figure 5:
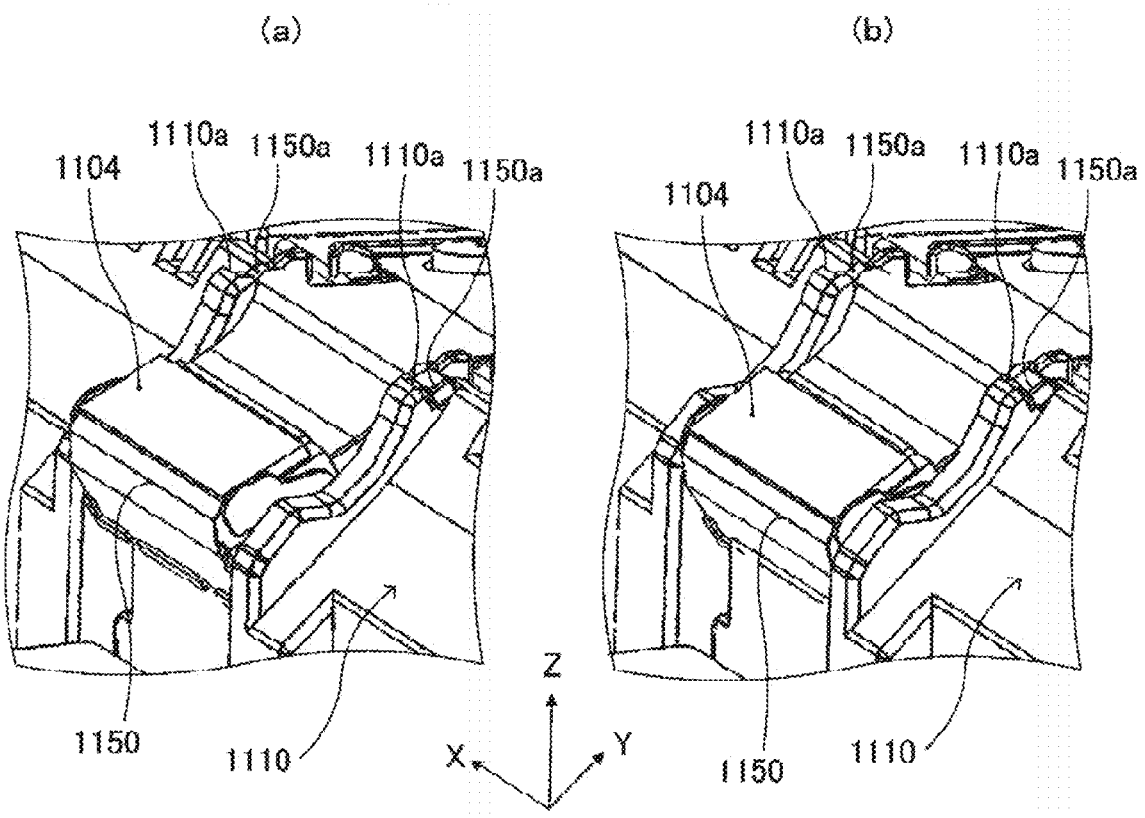
FIG. 5 is a perspective view of a separation pad.

FIG. 5 is a perspective view of the separation pad 1104, in particular, illustrates, at (a), the separation pad 1104 when the sheet cassette 11 is drawn from the apparatus main body of the printer 100, and illustrates, at (b), the separation pad 1104 when the sheet cassette 11 is attached to the apparatus main body of the printer 100.

The separation pad 1104 is affixed to a separation pad holder 1150, and the separation pad holder 1150 includes support shafts 1150*a* that are rotatably supported by holder support units 1110*a* that are arranged on a downstream side wall of a cassette housing 1110 in the sheet feed direction. Further, the separation pad holder 1150 is pressurized toward the sheet feed roller 111 by a pressurizing spring.

As illustrated at (b) in FIG. 5, when the sheet cassette 11 is attached to the apparatus main body of the printer 100, the separation pad holder 1150 is pushed inside between the side walls of the cassette housing 1110 by the sheet feed roller 111. In contrast, as illustrated at (a) in FIG. 5, when the sheet cassette 11 is drawn from the apparatus main body of the printer 100, there is no member that pushes the separation pad holder 1150 inward, so that the separation pad holder 1150 rotates in a clockwise direction in the figure by using the support shafts 1150*a* as supporting points, so that an upstream side of the separation pad holder 1150 in the feed direction largely protrudes from the downstream side wall of the cassette housing 1110 in the feed direction.

The sheet cassette 11 of the present embodiment is able to restrict positions of sheets at a minimum of A6 size (width: 105 mm, length: 148 mm) by the side fences 1101 and 1102 and the end fence 1103. In contrast, although use frequency in the market is low, special types of business need to use a "special small size", such as a student certificate card (B7 size), that is smaller than the A6 size, for example. If the side fences and the end fence of the sheet cassette 11 are configured so as to be able to restrict a special small size sheet as described above, it is necessary to extend the end fence escaping gutter 1105*b* on the bottom plate 1105 to the downstream end in the feed direction and further extend the the side fence escaping holes 1105*c* toward the center in the width direction. If the end fence escaping gutter 1105*b* and the side fence escaping holes 1105*c* are extended as described above, the strength of the bottom plate 1105 may be reduced and it may become difficult to support a sheet bundle stacked on the bottom plate 1105.

To cope with this, in the present embodiment, an attachment that includes a small size end fence for controlling a position of a trailing end of the above-described special small size sheet is attachable to and detachable from the bottom plate 1105.

Figure 6A:
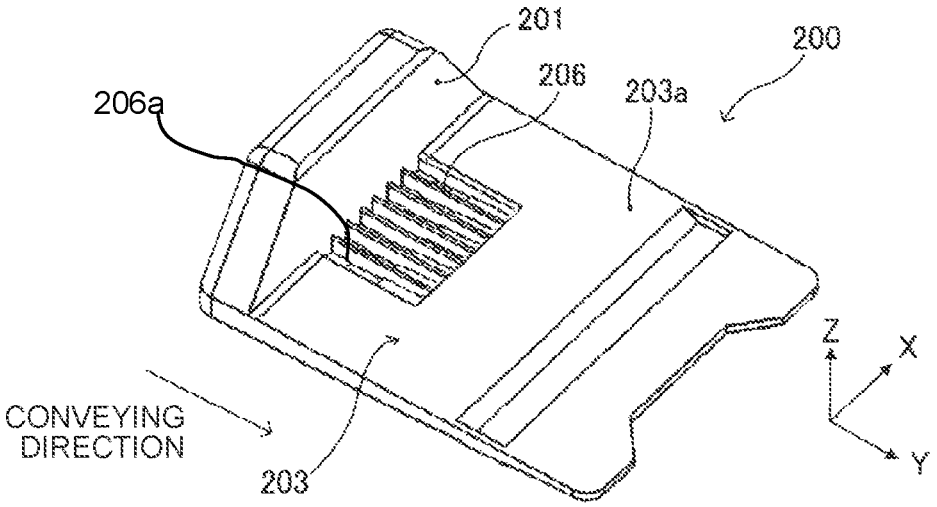
FIGS. 6A to 6C are diagrams illustrating an attachment.
Figure 6B:
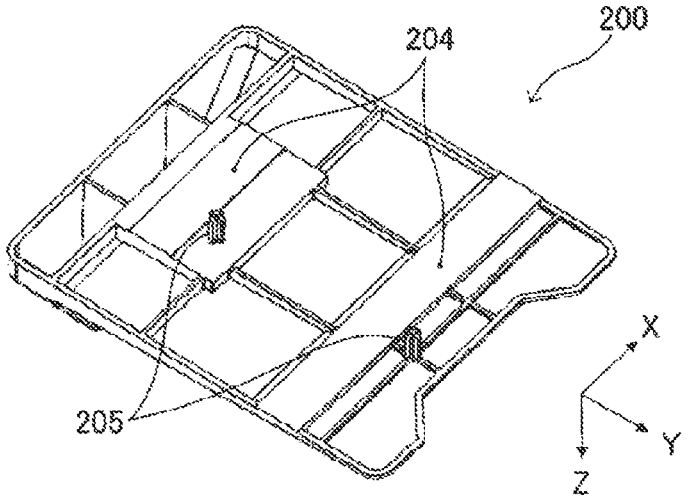
Figure 6C:
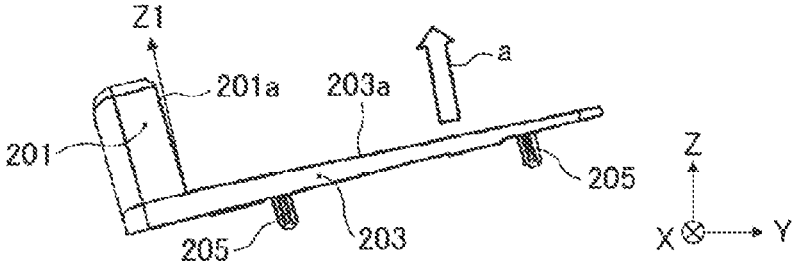

FIG. 6A is a perspective view of the attachment 200, FIG. 6B is a perspective view of a back side of the attachment 200, and FIG. 6C is a side view of the attachment 200.

The attachment 200 is a resin molded product, and includes a stacking part 203 on which a sheet with a special small size is stacked and a small size end fence 201. The small size end fence 201 is arranged on a downstream end portion of the stacking part 203 in the feed direction. Further, as illustrated in FIG. 6B, two attaching protrusions 205 that are to be inserted in the attachment attaching holes 1105*d* of the bottom plate 1105 are arranged in the feed direction on the back side of the stacking part 203 facing the bottom plate 1105. Furthermore, bonding surfaces 204 are arranged on the back side of the stacking part 203. By affixing double-stick tapes to or by applying adhesive agent to the bonding surfaces 204, it is possible to fix the attachment 200 to the bottom plate 1105.

Moreover, portions corresponding to the bonding surfaces 204, of the sheet stacking side of the stacking part 203 are recessed by forming concaves to prevent portions of the bonding surfaces 204 of the stacking part 203 from becoming thicker than other portions. With this configuration, it is possible to prevent a recess from being formed on the bonding surfaces 204 due to sink marks, so that it is possible to prevent reduction in flatness of the bonding surfaces 204 and it is possible to fix the attachment 200 to the bottom plate 1105 in a preferred manner with double-stick tapes or adhesive agent.

Furthermore, as illustrated in FIG. 6A, a plurality of ribs 206 that extend in the feed direction are formed in the recess 206*a* that is located downstream in the feed direction, on the sheet stacking side of the stacking part 203, and when a sheet bundle Ps of special small size sheets is set on the attachment 200, the ribs 206 prevent a trailing end of the sheet bundle Ps from falling in the downstream recess 206*a* in the feed direction. Moreover, as illustrated in FIG. 6C, a facing surface 201*a* of the small size end fence 201 facing the sheet bundle Ps is formed as an inclined surface that is inclined such that a higher part of the facing surface 201*a* is located more downstream in the feed direction with respect to a vertical direction Z1 of a stacking surface 203*a* that serves as a sheet stacking surface of the stacking part 203. Furthermore, as illustrated in FIG. 6C, the stacking surface 203*a* of the stacking part 203 for stacking sheets is formed as an inclined surface such that a height increases downstream in the feed direction.

FIGS. 7A to 7D are diagrams illustrating how the sheet bundle Ps with the special small size is set in the sheet cassette to which the attachment 200 is attached.

Figure 7B:
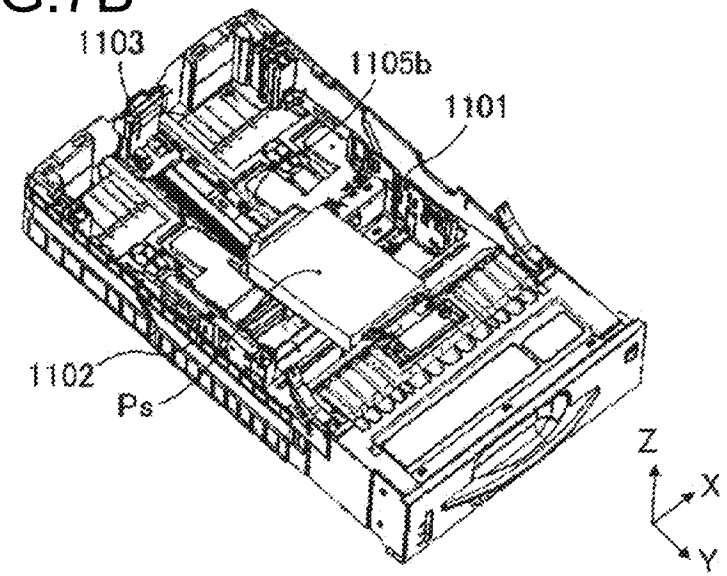
FIGS. 7A to 7D are diagrams illustrating how a special small size is set in a sheet cassette to which the attachment is attached.
Figure 7A:
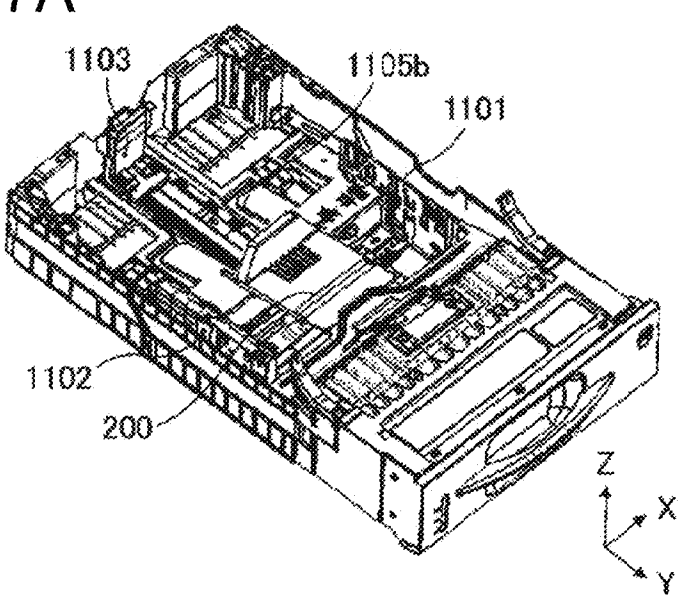

As illustrated in FIG. 7A, when the attachment 200 is attached to the bottom plate 1105, the end fence 1103 is moved upstream in the feed direction. Then, the attaching protrusions 205 of the attachment 200 are inserted in the attachment attaching holes 1105*d* on the bottom plate 1105, so that the attachment 200 is attached to the bottom plate 1105.

Subsequently, as illustrated in FIG. 7B, the trailing end of the sheet bundle Ps with the special small size is brought into contact with the small size end fence 201, and the sheet bundle Ps with the special small size is stacked on the stacking part 203 of the attachment 200. Then, the side fences 1101 and 1102 as a pair are slid towar the center in the width direction so that a gap between the side fences 1101 and 1102 as a pair is reduced, and the side fences 1101 and 1102 are brought into contact with end portions of the sheet bundle Ps of the special small size sheets in the width direction, so that the width-directional position of the sheet bundle Ps of the special small size sheets stacked on the stacking part 203 is restricted. Accordingly, it is possible to restrict the sheet bundle Ps with the special small size in the feed direction and in the width direction.

Figure 7D:
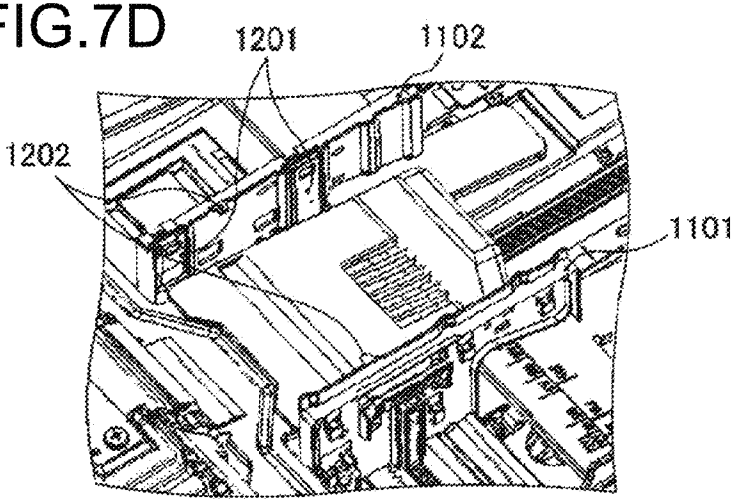
Figure 7C:
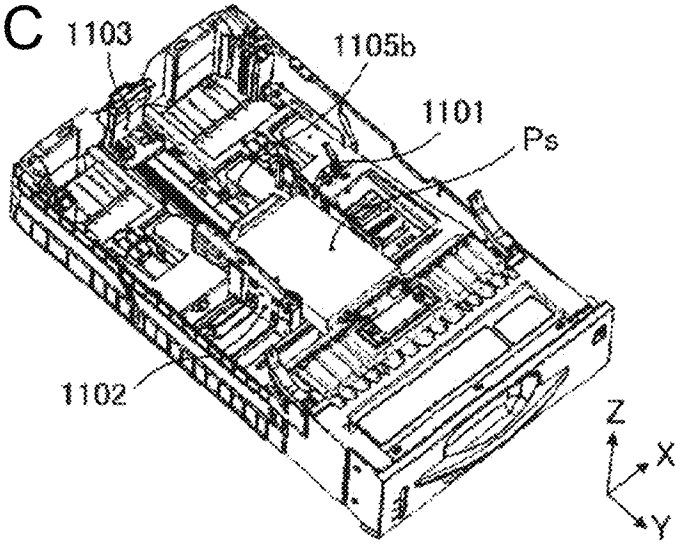

Furthermore, as illustrated in FIG. 7D, the side fences 1101 and 1102 as a pair on the sheet cassette 11 include falling preventive claws 1202 for preventing falling from the side fences. Moreover, the second side fence 1102 includes pressurizing members 1201 that pressurize one end of the sheet bundle in the width direction toward the first side fence 1101.

The side fences 1101 and 1102 as a pair are configured so as to move in a sliding manner in the width direction (X direction) as described above, so that backlash inevitably occurs in the width direction (X direction). As a result, even if the side fences 1101 and 1102 are moved so as to come into contact with the end portions of the sheet bundle in the width direction, gaps may occur between the side fences and the sheet bundle due to the backlash as described above.

If the gaps occur between the side fences and the sheet bundle, the position of the sheet bundle in the width direction (X direction) is not restricted. Consequently, the position in the width direction (X direction) may vary for each sheet to be fed, so that a position of an image formed on a sheet in the width direction may vary for each sheet, or a sheet may be conveyed in a skewed manner and an image may be formed in an inclined manner on the sheet.

However, in the present embodiment, the pressurizing members 1201, parts of which protrude from the second side fence 1102, are arranged on the second side fence 1102. With this configuration, even if gaps occur between the side fences 1101 and 1102 as a pair and the sheet bundle due to structural backlash or the like, pressurizing surfaces of the pressurizing members 1201 protruding from the second side fence 1102 come into elastic contact with one end of the sheet bundle in the width direction. Therefore, sheets in the sheet bundle are pressurized by the pressurizing members 1201 toward the first side fence 1101, so that the sheet bundle is moved and comes into contact with the first side fence 1101. Consequently, the width-directional position of the sheet bundle is restricted by the pressurizing members 1201 and the first side fence 1101. With this configuration, it is possible to adjust the width-directional positions and posture of the sheets to be fed, so that it is possible to prevent variation in image forming positions on the sheets.

In the present embodiment, the position of the trailing end of the sheet bundle Ps with the special small size is restricted by the small size end fence 201 arranged on the attachment 200, so that it is not necessary to extend the end fence escaping groove 1105*b* of the bottom plate 1105 to the position of the small size end fence 201. Therefore, as compared to a case in which both of the end fence escaping groove 1105*b* and the side fence escaping holes 1105*c* on the bottom plate 1105 are extended to cope with the sheet bundle Ps with the special small size, it is possible to prevent reduction in the strength of the bottom plate 1105.

Furthermore, in the present embodiment, the width-directional position of the sheet bundle Ps with the special small size, which is formed of the special small size sheets, is restricted by using the side fences 1101 and 1102 that are provided in the sheet cassette 11. With this configuration, when the sheet bundle Ps with the special small size is set in the attachment 200, it is possible to allow the side fences 1101 and 1102 to be evacuated, so that it is possible to easily set the sheet bundle Ps with the special small size in the attachment 200. In addition, as compared to a case in which a pair of side fences are arranged on the attachment 200, it is possible to reduce a cost of the attachment 200.

Moreover, the side fences 1101 and 1102 provided in the sheet cassette 11 include, as illustrated in FIG. 7D as described above, the pressurizing members 1201 and the falling preventive claws 1202. Therefore, as for the restriction of the width-directional position of the sheet bundle Ps with the special small size, with use of the side fences 1101 and 1102 provided in the sheet cassette 11, it is possible to prevent falling of a sheet bundle, in particular, even the sheet bundle Ps with the special small size, stacked on the attachment 200, and it is possible to reliably perform restriction in the width direction by using the pressurizing members 1201.

Figure 8A:
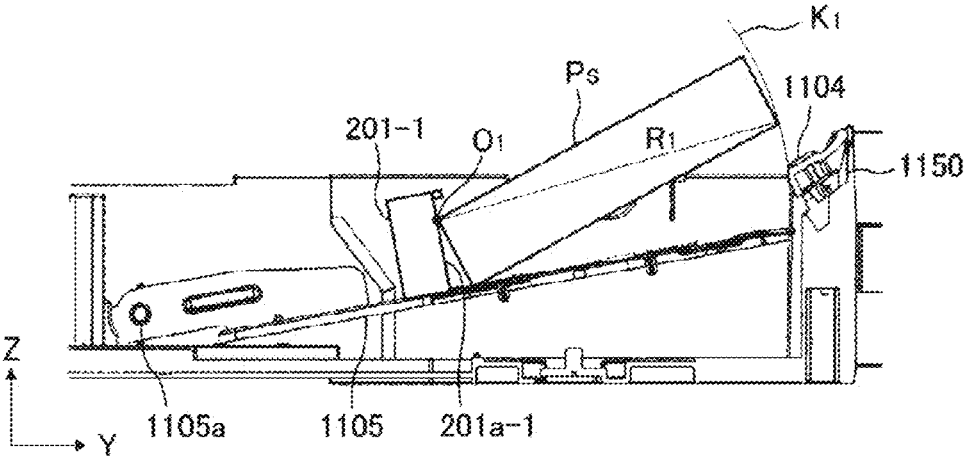
FIG. 8A is a diagram for explaining how to set a sheet bundle in an attachment according to a first comparative example.
Figure 8B:
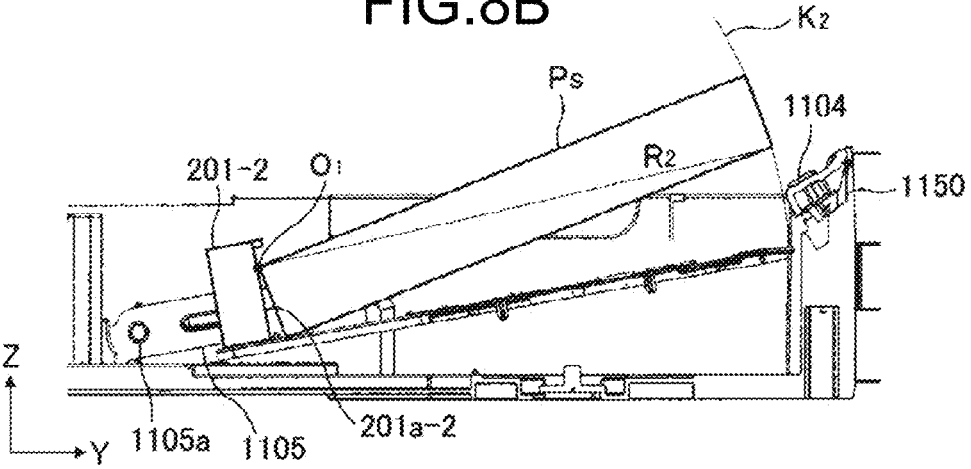
FIG. 8B is a diagram for explaining how to set a sheet bundle with a long sheet length.
Figure 8C:
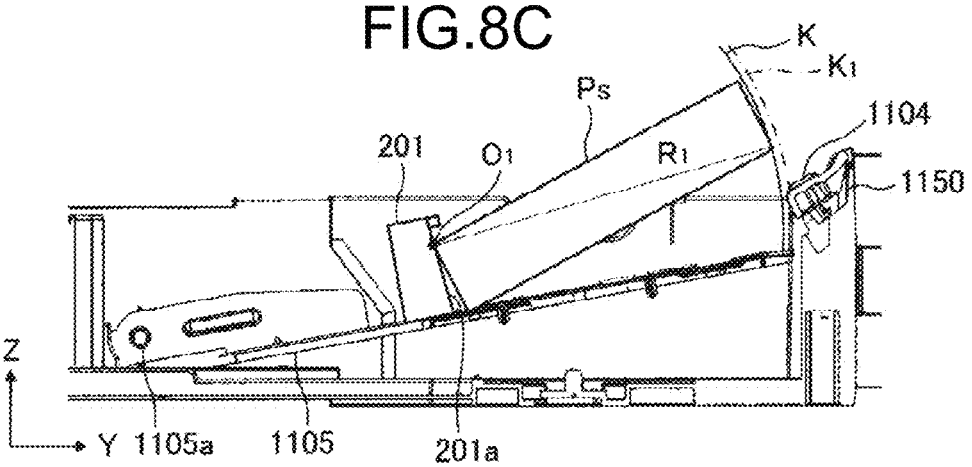
FIG. 8C is a diagram for explaining how to set a sheet bundle in the attachment according to the present embodiment.

FIG. 8A is a diagram for explaining how to set the sheet bundle Ps with the special small size in the attachment 200 of a first comparative example, in which the facing surface 201*a* of the small size end fence 201 facing the sheet bundle is parallel to the vertical direction Z1 of the stacking part 203. FIG. 8B is a diagram for explaining how to set a sheet bundle with a long sheet length. FIG. 8C is a diagram for explaining how to set the sheet bundle Ps with the special small size in the attachment 200 of the present embodiment, in which the facing surface 201*a* of the small size end fence 201 facing the sheet bundle is inclined with respect to the vertical direction Z1 of the stacking part 203.

As illustrated in FIGS. 8A to 8C, the sheet bundle is set such that the sheet cassette 11 is drawn from the apparatus main body of the printer 100. As for a sheet bundle with a short sheet length, a user holds a part of the sheet bundle close to the leading end and brings a part of the sheet bundle close to a trailing end into contact with the stacking surface 203*a* of the attachment 200. Then, while the part of the sheet bundle close to the leading end is lifted up, the trailing end of the sheet bundle is made to slide on the stacking surface 203*a* and the sheet bundle is moved to downstream in the feed direction, so that a trailing end of an upper portion of the sheet bundle comes into contact with the small size end fence 201. If the trailing end comes into contact with the small size end fence 201, as illustrated in FIG. 8A to FIG. 8C, the sheet bundle is rotated in the clockwise direction in the figures by using an upper trailing end portion O1 of the sheet bundle being in contact with the small size end fence 201 as a supporting point, so that the leading end of the sheet bundle is lifted down and the sheet bundle is set in the attachment 200.

As can be seen from comparison between FIG. 8A and FIG. 8B, a small size end fence 201-1 of the attachment of the first comparative example, which is compatible with special small size sheets, is located above an end fence 201-2 of an attachment as illustrated in FIG. 8B, which is compatible with sheets with a longer sheet length than the length of the special small size. Therefore, the rotation supporting point O1 that is used at the time of setting the sheet bundle is located higher than in FIG. 8B. In a case where the sheet bundle is set by being rotated, the leading end of the sheet bundle is located most downstream in the feed direction when a rotation radius R is parallel to the feed direction. The rotation supporting point O1 in FIG. 8A is located higher than in FIG. 8B; therefore, a position of the sheet bundle in the vertical direction at the time the leading end of the sheet bundle is located most downstream in the feed direction is close to the separation pad holder 1150. As a result, in the attachment 200 for the special small size as illustrated in FIG. 8A, when the sheet bundle is to be set, the leading end of the sheet bundle hooks on a portion of the separation pad holder 1150 protruding upstream in the feed direction, so that setting performance is reduced, which is a problem.

In contrast, in the attachment 200 of the present embodiment, the facing surface 201*a* of the small size end fence 201 facing the sheet bundle is inclined such that the upper part is located upstream in the feed direction relative to the lower part. With this configuration, as compared to the attachment of the comparative example as illustrated in FIG. 8A in which a facing surface 201*a*-1 is perpendicular to the stacking surface 203*a*, it is possible to locate the rotation supporting point, which is used at the time of setting the sheet bundle, upstream in the feed direction. With this configuration, as illustrated in FIG. 8C, it is possible to shift a moving trajectory K of the leading end of the sheet bundle at the time of setting the sheet bundle upstream in the feed direction relative to a moving trajectory K1 of the leading end of the sheet bundle in the attachment of the comparative example indicated by a chain line in FIG. 8C. Consequently, when a sheet bundle of special small size sheets is to be set in the attachment, it is possible to prevent the leading end of the sheet bundle from hooking on the separation pad holder 1150, so that it is possible to improve setting performance of the sheet bundle of the special small size sheets.

Furthermore, as described above, when the special small size sheets are to be set, the trailing end of the sheet bundle is made to slide on the stacking surface 203*a* and the sheet bundle is moved downstream in the feed direction while the part of the sheet bundle close to the leading end is lifted up, so that the trailing end of the upper portion of the sheet bundle comes into contact with the small size end fence 201. In this case, if the plurality of ribs 206 extending in the feed direction are not arranged in the recess that is located downstream in the feed direction on the sheet stacking side of the stacking surface 203*a* unlike the configuration as illustrated in FIG. 6A, and when the trailing end of the lowermost sheet in the sheet bundle that has been moved in a sliding manner on the stacking part 203 reaches the recess, the trailing end of the lowermost sheet in the sheet bundle facing the recess is bent, so that the trailing end comes into contact with a lower surface of the recess and slides on the lower surface. In this case, the bent portion may be twisted due to sliding resistance of the lower surface, and the lowermost sheet may be folded.

However, in the present embodiment, the ribs 206 are arranged in the recess, so that when the trailing end of the lowermost sheet in the sheet bundle that has been moved in a sliding manner on the stacking part 203 reaches the recess, the trailing end comes into contact with the ribs 206 and is prevented from being bent. With this configuration, it is possible to prevent the trailing end of the lowermost sheet from being twisted when the sheet bundle is set in the attachment 200, so that it is possible to prevent the lowermost sheet in the sheet bundle from being folded.

Furthermore, in the present embodiment, the facing surface 201*a* of the small size end fence 201 facing the sheet bundle is configured as an inclined surface, so that it is possible to reduce positional misalignment of the leading end of the lowermost sheet in the feed direction when the number of sheets in the sheet bundle is reduced, as compared to a case in which the facing surface 201*a* of the small size end fence facing the sheet bundle is configured as a vertical surface with respect to the stacking part 203. This will be described below with reference to FIGS. 9A and 9B.

Figure 9A:
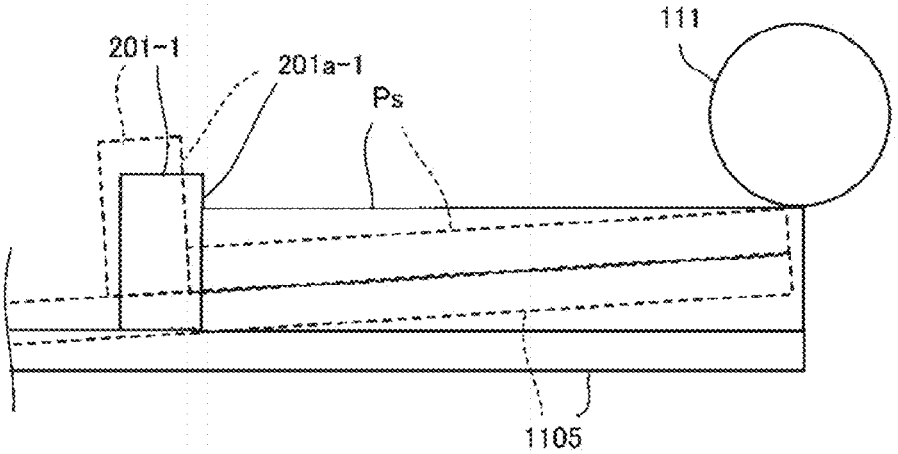
FIG. 9A is a diagram illustrating a case in which a large number of sheets are stacked in the attachment of the comparative example and a case in which a small number of sheets are stacked in the attachment of the comparative example.
Figure 9B:
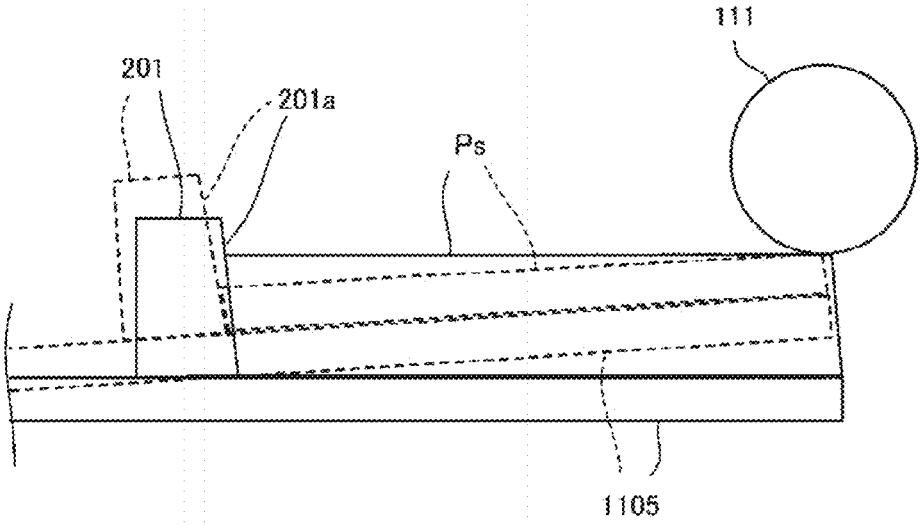
FIG. 9B is a diagram illustrating a case in which a large number of sheets are stacked in the attachment of the present embodiment and a case in which a small number of sheets are stacked in the attachment of the present embodiment.

FIG. 9A is a diagram illustrating a case in which a large number of sheets are stacked in the attachment of the comparative example in which the facing surface 201*a*-1 of the small size end fence 201-1 facing the sheet bundle is configured as a vertical surface with respect to the stacking part 203, and a case in which a small number of sheets are stacked in the attachment of the comparative example. FIG. 9B is a diagram illustrating a case in which a large number of sheets are stacked in the attachment of the present embodiment in which the facing surface 201*a* of the small size end fence 201 facing the sheet bundle is configured as an inclined surface with respect to the stacking part 203, and a case in which a small number of sheets are stacked in the attachment of the present embodiment.

The attachment 200 is attached to the bottom plate 1105 that rotates in a counterclockwise direction in the figure with a downstream part thereof in the feed direction as a supporting point. Therefore, when the attachment 200 rotates in the counterclockwise direction in the figure together with the bottom plate 1105 as the number of sheets in the sheet bundle decreases, the position of the small size end fence is moved upstream in the feed direction as the number of sheets in the sheet bundle decreases.

As illustrated in FIG. 9A, in the comparative example, a position of a leading end of an upper sheet, which is indicated by a dashed line in the figure, in a sheet bundle Ps containing a small number of sheets is largely deviated upstream in the feed direction with respect to a position of a leading end of an uppermost sheet, which is indicated by a solid line in the figure, in the sheet bundle Ps containing a large number of sheets. If the position of the leading end of the uppermost sheet in the feed direction is largely changed between when the sheet bundle contains a large number of sheets and when the sheet bundle contains a small number of sheets as described above, a contact relation with the sheet feed roller 111 is largely changed between when the sheet bundle contains a large number of sheets and when the sheet bundle contains a small number of sheets, so that when the number of sheets in the sheet bundle is reduced, it may become difficult to appropriately feed a sheet in the sheet bundle by the sheet feed roller 111 and a feed failure may occur.

In contrast, in the present embodiment, the facing surface 201*a* is inclined such that the upper part is located upstream in the feed direction relative to the lower part. Therefore, when the sheet bundle comes into contact with the facing surface 201*a* of the small size end fence, as indicated by a solid line in FIG. 9B, a leading end of a sheet in a lower part of the sheet bundle is located downstream in the feed direction relative to an upper part. If the number of sheets in the sheet bundle is reduced, the sheet that was located in the lower part when the sheet bundle contained a large number of sheets comes into contact with the sheet feed roller 111. The sheet in the lower part is located downstream in the feed direction relative to the upper part as described above. Therefore, even if the position of the leading end of the sheet bundle is deviated upstream in the feed direction as the number of sheets in the sheet bundle decreases, it is possible to reduce positional misalignment in the feed direction between a position of a leading end of an uppermost sheet that comes into contact with the sheet feed roller 111 and that is indicated by a dashed line in FIG. 9B and a position of a leading end of an uppermost sheet that is included in the sheet bundle containing a large number of sheets and that is indicated by the solid line in FIG. 9B. With this configuration, the contact relation with the sheet feed roller 111 is not largely changed between when the sheet bundle contains a large number of sheets and when the sheet bundle contains a small number of sheets, so that feed conditions are not largely changed. Consequently, even if the number of sheets in the sheet bundle is reduced, it is possible to appropriately feed a sheet in the sheet bundle by using the sheet feed roller 111, so that it is possible to prevent a feed failure.

Next, modifications of the attachment will be described.

First Modification

Figure 10A:
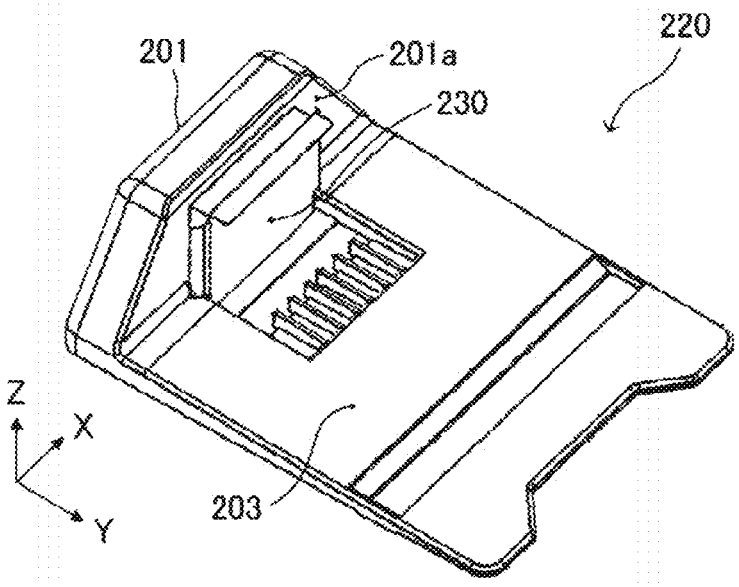
FIGS. 10A and 10B are perspective views of an attachment of a first modification.
Figure 10B:
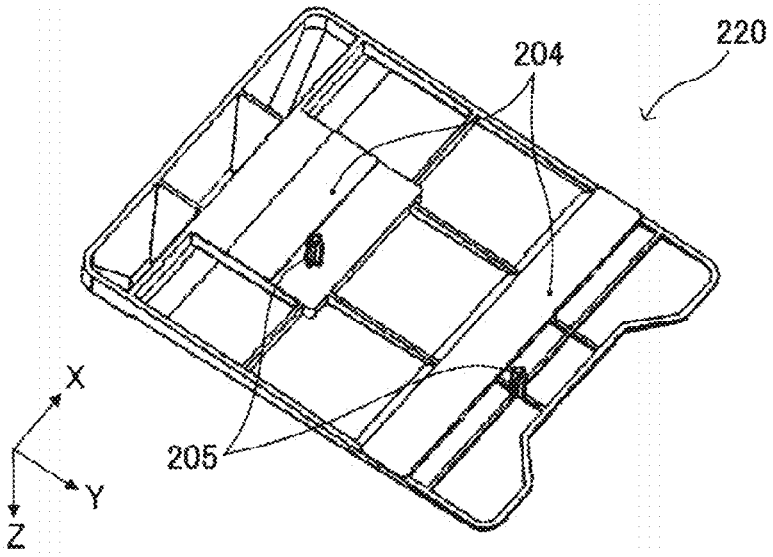

FIGS. 10A and 10B are perspective views of an attachment 220 of a first modification.

The attachment 220 of the first modification includes an elastic deformable member 230 that is arranged on the facing surface 201*a* of the small size end fence 201 such that a small size end fence 201 can be elastically deformed in the feed direction.

Figure 11:
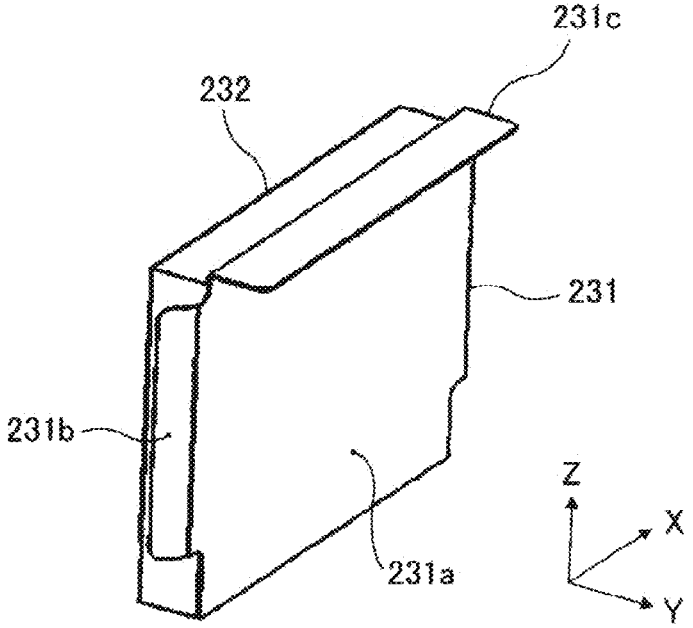
FIG. 11 is a perspective view of an elastic deformable member.

FIG. 11 is a perspective view of the elastic deformable member 230.

The elastic deformable member 230 includes an elastic member 232, such as a sponge, and a sheet contact member 231, such as a PET sheet, that is arranged on a certain surface of the elastic member 232 facing a sheet bundle and that comes into contact with a trailing end of the sheet bundle. As the elastic member 232, a resin elastic body, such as a spring or rubber, may be used. Further, a material with a smaller friction coefficient against a sheet than the elastic member 232 is sufficient as a material of the sheet contact member 231, and a sheet metal may be adopted. Furthermore, an upper portion of the sheet contact member 231 is folded downstream in the feed direction, and a sheet restriction surface 231*a* and an eaves portion 231*c* are arranged.

Figure 12:
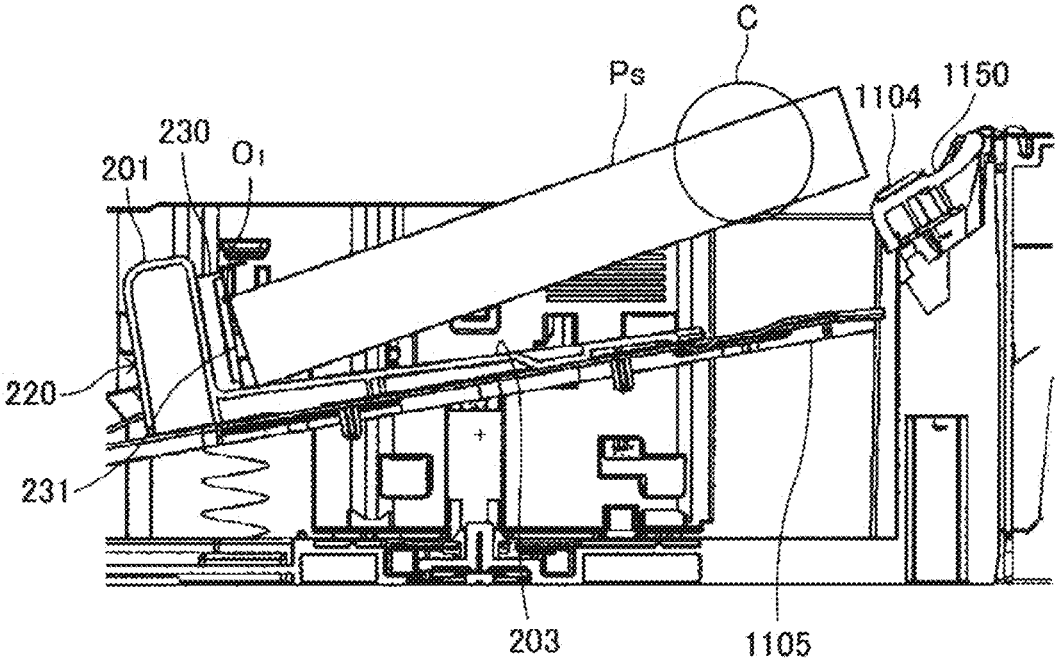
FIG. 12 is a diagram illustrating how to set a sheet bundle with a special small size in the attachment of the first modification attached to the bottom plate.

FIG. 12 is a diagram illustrating how to set the sheet bundle Ps of special small size sheets in the attachment 200 of the first modification attached to the bottom plate 1105.

As described above, a user holds a part of the sheet bundle close to a leading end (a portion denoted by C in FIG. 12), moves the sheet bundle upstream in the feed direction while the part of the sheet bundle close to the leading end is lifted up, and brings an upper trailing end portion of the sheet bundle into contact with the small size end fence 201. In the first modification, the upper trailing end portion of the sheet bundle comes into contact with the elastic deformable member 230 of the small size end fence 201. Then, while the upper trailing end portion O1 of the sheet bundle is pressed against the elastic deformable member 230, the sheet bundle Ps is rotated in the clockwise direction in the figure by using the upper trailing end portion O1 of the sheet bundle as a supporting point, so that the sheet bundle Ps is set in the attachment of the first modification. In this case, the upper trailing end portion O1 of the sheet bundle is pressed against the elastic deformable member 230, so that the elastic deformable member 230 is elastically deformed (compressive elastic deformation) downstream in the feed direction. Accordingly, the rotation supporting point O1 (the upper trailing end portion of the sheet bundle) that is used at the time of setting the sheet bundle in the attachment moves upstream in the feed direction, so that it is possible to shift a moving restriction of the leading end of the sheet bundle upstream in the feed direction. With this configuration, when the sheet bundle Ps is to be set in the attachment 220, it is possible to prevent the leading end of the sheet bundle from hooking on the portion of the separation pad holder 1150 protruding upstream in the feed direction, so that it is possible to improve setting performance of the sheet bundle in the attachment 220.

Further, after the sheet bundle is set, it is possible to push the sheet bundle downstream in the feed direction with the aid of a restoring force of the elastic deformable member 230 and cause the leading end of the sheet bundle to come into contact with a downstream side wall surface of the cassette housing 1110 in the feed direction. In the first modification, the elastic deformable member 230 is extended to a lower end of the small size end fence, so that it is possible to push even a last sheet downstream in the feed direction with the aid of the restoring force of the elastic deformable member 230 and cause the leading end of the last sheet to come into contact with the downstream side wall surface of the cassette housing 1110 in the feed direction.

As described above with reference to FIGS. 9A and 9B, with reduction in the number of sheets in the sheet bundle, the bottom plate 1105 rotates such that the downstream side of the bottom plate 1105 in the feed direction moves upward, so that the position of the small size end fence 201 of the attachment 220 is moved upstream in the feed direction. However, in the first modification, the elastic deformable member 230 pushes the sheets downstream in the feed direction, so that even if the position of the small size end fence 201 of the attachment 220 is moved upstream in the feed direction, it is possible to cause the leading ends of the sheets to come into contact with the downstream side wall of the cassette housing 1110 in the feed direction with the aid of the elastic force of the elastic deformable member 230, and it is possible to prevent upstream displacement of the leading ends of the sheets in the feed direction as the number of sheets in the sheet bundle decreases. Consequently, it is possible to appropriately feed a sheet set in the attachment 220.

Furthermore, in the first modification, the elastic deformable member 230 includes the eaves portion 231*c*, so that a trailing end portion of a top surface of the sheet bundle set in the attachment 220 faces the eaves portion 231*c*. With this configuration, it is possible to cause the eaves portion 231*c* to press an upper sheet in the sheet bundle set in the attachment 220 when the upper sheet flows due to a certain cause. Consequently, it is possible to prevent sheets in the sheet bundle set in the attachment from coming off across the small size end fence 201.

Moreover, it may be possible to arrange an eaves portion on the small size end fence 201. Even if the eaves portion is arranged on the small size end fence 201, similarly to the case in which the eaves portion is arranged on the elastic deformable member 230, it is possible to prevent sheets in the sheet bundle set in the attachment from coming off. However, from the viewpoint of the setting performance, it is preferable to arrange the eaves portion on the elastic deformable member 230.

Figure 13A:
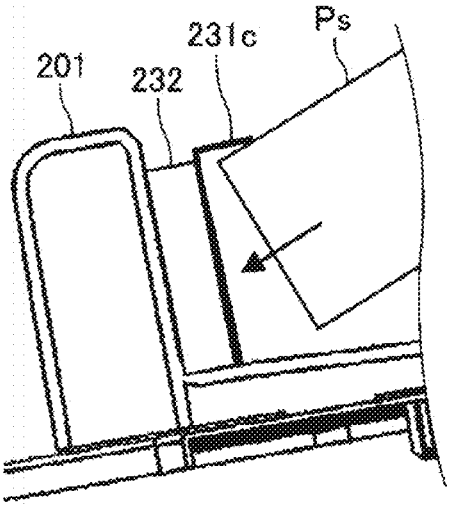
FIGS. 13A to 13D are enlarged views of a periphery of a small size end fence when the sheet bundle is set in the attachment.
Figure 13B:
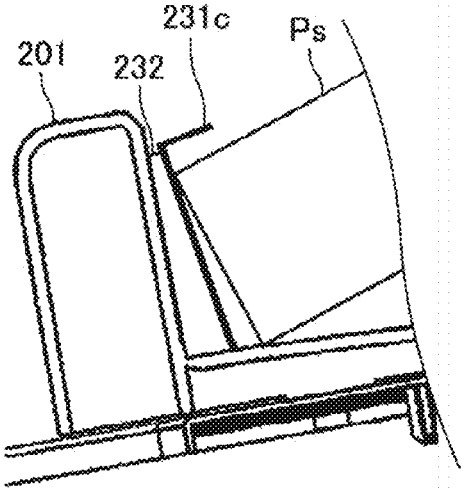
Figure 13C:
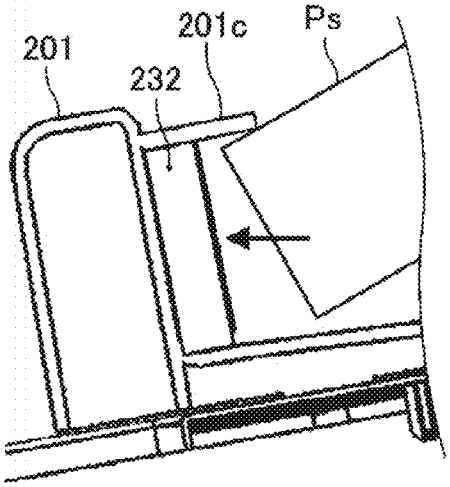
Figure 13D:
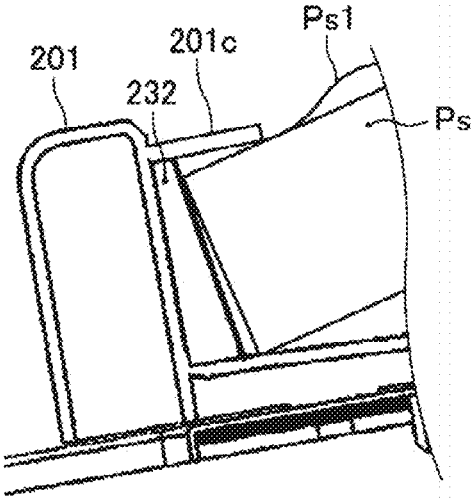

FIGS. 13A to 13D are enlarged views of a periphery of the small size end fence when the sheet bundle is set in the attachment. FIG. 13A and FIG. 13B illustrate a case in which the eaves portion is arranged on the elastic deformable member 230, and FIG. 13C and FIG. 13D illustrate a case in which the eaves portion is arranged on the small size end fence.

As illustrated in FIG. 13A and FIG. 13C, when the upper trailing end portion of the sheet bundle Ps is brought into contact with the end fence, a top surface of the sheet bundle Ps may come into contact with the eaves portion. As illustrated in FIG. 13D, when the eaves portion 201*c* is arranged on the small size end fence 201, and if the top surface of the sheet bundle Ps comes into contact with the eaves portion 201*c*, a trailing end of an uppermost sheet Ps1 in the sheet bundle Ps may be twisted due to sliding resistance of the eaves portion 201*c* even after the trailing end is moved downstream in the feed direction. Therefore, if the eaves portion 201*c* is arranged on the small size end fence 201, it is necessary to set the sheet bundle Ps in a laid manner in the attachment while taking care not to bring the top surface of the sheet bundle Ps into contact with the eaves portion 201*c*, which makes the setting cumbersome.

In contrast, as illustrated in FIG. 13B, when the eaves portion 231*c* is arranged on the elastic deformable member 230, and if the top surface of the sheet bundle Ps comes into contact with the eaves portion 231*c*, an edge of the eaves portion is pushed upstream in the feed direction, so that an upper part of the elastic member 232 is elastically deformed and the eaves portion 231*c* rotates in a direction in which the eaves portion 231*c* is evacuated from the top surface of the sheet bundle Ps. As a result, sliding resistance between the eaves portion 231*c* and the top surface of the sheet bundle Ps is reduced, and the trailing end of the uppermost sheet of the sheet bundle Ps is not moved downstream in the feed direction. With this configuration, it is possible to set the sheet bundle without laying the sheet bundle Ps, so that it is possible to easily set the sheet bundle.

Second Modification

Figure 14A:
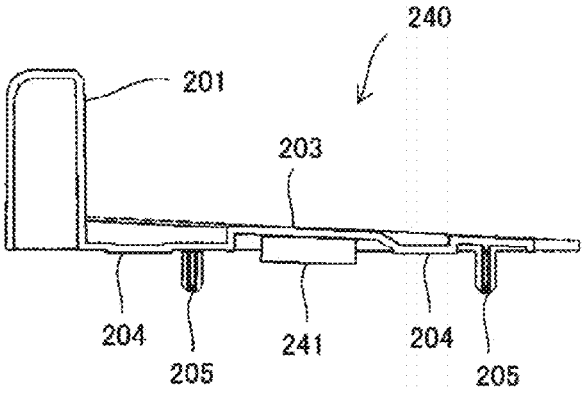
FIGS. 14A and 14B are diagrams illustrating an attachment of a second modification.
Figure 14B:
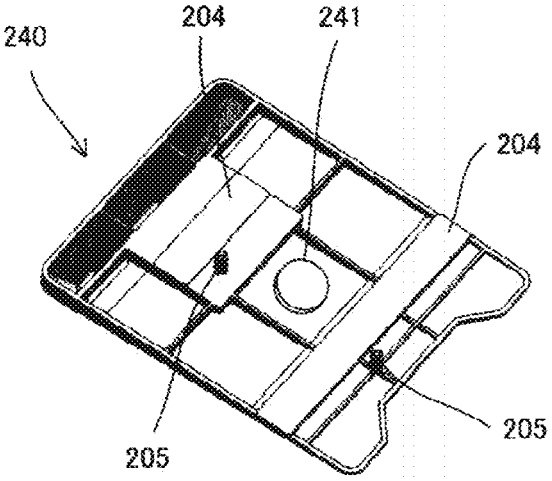

FIGS. 14A and 14B are diagrams illustrating an attachment 240 of a second modification.

The attachment 240 of the second modification includes a weight 241 to increase weight of the attachment 240.

The weight 241 is affixed, with a double-stick tape, to a portion on the back side of the stacking part 203 facing the pinion escaping hole 1105*e* of the bottom plate 1105. Meanwhile, in the present modification, the weight 241 is arranged in a portion M1 facing the pinion escaping hole 1105*e*, but embodiments are not limited to this example, and, for example, as illustrated in FIG. 14B, the weight 241 may be arranged in any place where there is no problem to arrange the weight 241, such as a hollow portion M2 of the small size end fence 201 or portions M3 and M4 that are adjacent to, in the width direction, the portion M1 facing the pinion escaping hole 1105*e*. However, it is preferable to arrange the weight 241 in the portion M1 that is located at approximately center of the attachment 240 because the center of gravity of the attachment 240 is stabilized.

Figure 15:
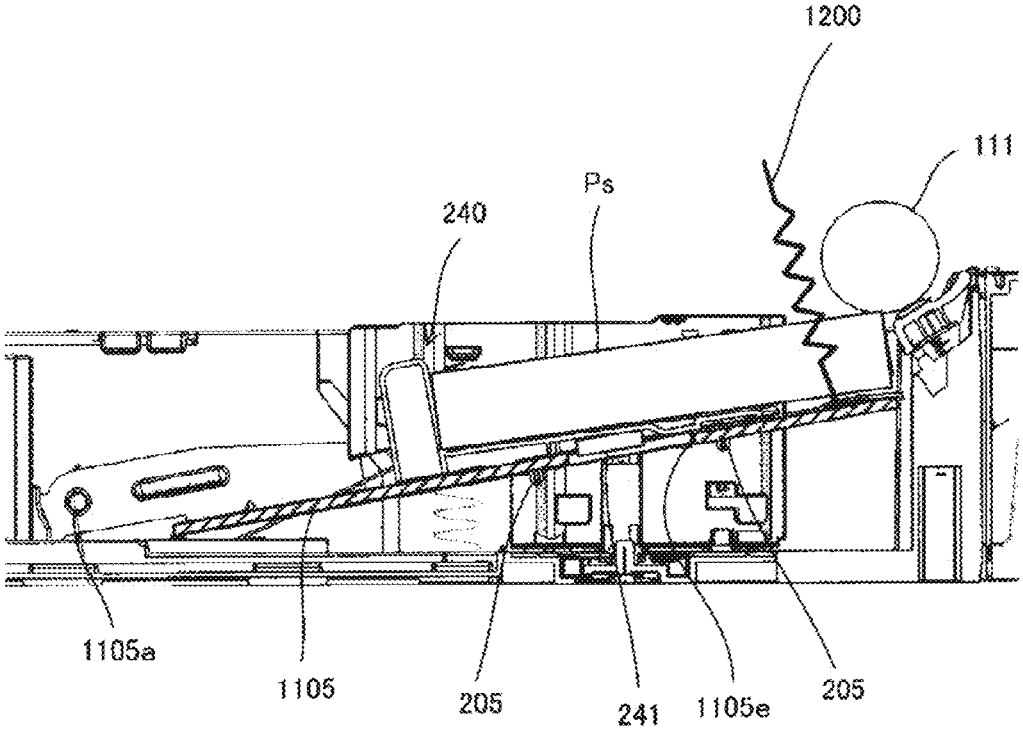
FIG. 15 is a diagram illustrating how to attach the attachment of the second modification to the bottom plate.

FIG. 15 is a diagram illustrating how to attach the attachment 240 of the second modification to the bottom plate 1105.

As illustrated in FIG. 15, the downstream part of the bottom plate 1105 in the feed direction is pulled upward by a sheet feed pressure spring 1200 in a state in which the sheet cassette 11 is attached to the apparatus main body, and a leading end of the uppermost sheet of the sheet bundle comes into contact with the sheet feed roller 111 at a predetermined sheet feed pressure by a biasing force of the sheet feed pressure spring 1200. Specifically, the sheet feed pressure is equal to a sum of moments around the support holes 1105*a* that serve as rotation supporting points of the bottom plate 1105, where the moments are generated by the weight of the bottom plate 1105, a position of the center of gravity of the bottom plate 1105 (if the attachment is attached, the weight of the bottom plate 1105 and the position of the center of gravity of the bottom plate 1105 in a state in which the attachment is attached), weight of the sheet bundle, a position of the center of gravity of the sheet bundle, the biasing force of the sheet feed pressure spring 1200, and a position of action of the sheet feed pressure spring 1200.

The sheet bundle Ps with the special small size stacked on the attachment has a small size, so that the weight of the sheet bundle is smaller than the weight of a sheet bundle with a normal size. As a result, the sheet feed pressure increases more than is needed, and a feed failure is likely to occur.

To cope with this, in the attachment 240 of the second modification, the weight 241 is attached to increase the weight of the attachment 240, so that the sheet feed pressure at the time the sheet bundle with the special small size is set is optimized. With this configuration, it is possible to appropriately feed a sheet with a special small size.

Meanwhile, in the examples as described above, the separation pad is used as a separation member that separates the uppermost sheet, which comes into contact with the sheet feed roller 111 and to which a conveying force is applied by the sheet feed roller 111, from other sheets; however, it may be possible to use a separation roller. Even if the separation roller is used, when the sheet cassette 11 is drawn from the apparatus main body, a part of the separation roller protrudes from the downstream side wall of the cassette housing 1110 of the sheet cassette 11 in the feed direction. Therefore, similarly to the separation pad, when the sheet bundle Ps with the special small size is set in the attachment by being rotated while the upper trailing end portion of the sheet bundle Ps with the special small size is brought into contact with the small size end fence 201, the leading end of the sheet bundle hooks on the separation roller and the setting performance is reduced. Therefore, with use of the attachment as described above, it is possible to improve the setting performance.

Further, while the attachment 200 as described above includes the stacking part 203, the stacking part 203 may be omitted.

The above-described cases are presented as examples, and specific effects are achieved for each of the following aspects.

(Aspect 1)

The attachment 200 that is attachable to and detachable from a sheet placing board, such as the bottom plate 1105, includes an end fence, such as the small size end fence 201, that restricts a position of a trailing end of a sheet in a sheet conveying direction, where the end fence includes the facing surface 201*a* facing the trailing end of the sheet, and the facing surface 201*a* includes an inclined surface that is inclined with respect to a vertical direction of a sheet stacking surface, such as the stacking surface 203*a*, such that a higher part of the facing surface is located more upstream in the sheet conveying direction.

If a configuration is made such that a position of a trailing end of a sheet with a special size in which a length in the conveying direction is shorter than a length of a normal size (hereinafter, referred to as a special small size sheet) is restricted by the end fence 1103 included in a feed tray, such as the sheet cassette 11, the end fence escaping groove 1105*b* that is arranged on the sheet stacking board, such as the bottom plate 1105, and that allows the end fence 1103 to escape is extended to the vicinity of a downstream end portion of the sheet stacking board in the sheet conveying direction. Therefore, strength of the sheet stacking board may be reduced. To cope with this, in Aspect 1, the attachment 200 including the end fence is provided, and if the special small size sheet is to be set, the attachment 200 is attached to the sheet placing board and the special small size sheet is set. With this configuration, it is possible to restrict the position of the trailing end of the special small size sheet by using the end fence of the attachment 200, so that it is not necessary to extend the end fence escaping groove 1105*b*, which allows the end fence of the sheet stacking board to escape, to the vicinity of the downstream end portion in the sheet conveying direction. As a result, it is possible to ensure the strength of the sheet placement board.

However, in the attachment 200 including the end fence as described above, sheet setting performance may be reduced.

When a sheet bundle with the special small size is to be set in the sheet stacking board to which the attachment 200 is attached, the trailing end of the sheet bundle is made to slide on the stacking surface and the sheet bundle is moved upstream in the sheet conveying direction while the part of the sheet bundle close to a leading end is held and lifted up. Subsequently, if an upper portion of the trailing end of the sheet bundle comes into contact with the end fence of the attachment 200, the sheet bundle is set by being rotated with the upper portion of the trailing end of the sheet bundle being in contact with the end fence of the attachment 200 as a supporting point such that the part of the sheet bundle close to the leading end approaches the sheet stacking surface. When the sheet bundle is set by being rotated, as described above with reference to FIGS. 8A to 8C, the leading end of the sheet bundle is likely to come into contact with a protruding member, such as the separation pad holder 1150, that protrudes downstream in the sheet conveying direction from a downstream end portion of the feed tray in the feed direction, so that the setting performance is reduced.

To cope with this, in Aspect 1, the facing surface 201*a* of the end fence of the attachment 200 facing the trailing end of the sheet is formed as an inclined surface that is inclined with respect to the vertical direction of the sheet stacking surface such that the upper part of the facing surface 201*a* is located upstream in the sheet conveying direction. With this configuration, a position at which the trailing end of the sheet bundle comes into contact with the end fence when the the upper portion of the trailing end of the sheet bundle comes into contact with the end fence of the attachment 200 is located upstream in the sheet conveying direction, as compared to a case in which the facing surface of the end fence is parallel to the vertical direction of the stacking part. Therefore, when the sheet bundle is to be set by being rotated by using the upper portion of the trailing end of the sheet bundle as a supporting point, a moving trajectory of the leading end of the sheet bundle can be shifted upstream in the sheet conveying direction, as compared to a case in which the facing surface 201*a* as described above is parallel to the vertical direction as described above. Consequently, when the sheet bundle is to be set, it is possible to prevent the part of the sheet bundle close to the leading end from coming into contact with the protruding member that protrudes upstream in the feed direction from the downstream end portion of the feed tray in the sheet conveying direction, so that it is possible to prevent reduction in the setting performance.

(Aspect 2)

In Aspect 1, the end fence, such as the small size end fence 201, includes an elastic deformable portion, such as the elastic deformable member 230, that is elastically deformable in the sheet conveying direction.

With this configuration, as described in the first modification, when the sheet bundle is set by being rotated while the upper portion of the trailing end of the sheet bundle is brought into contact with the end fence of the attachment 200, the elastic deformable portion is elastically deformed upstream in the conveying direction, and the position of the upper portion of the trailing end of the sheet bundle being in contact with the end fence of the attachment is moved upstream in the conveying direction. Consequently, it is possible to shift the moving trajectory of the leading end of the sheet bundle upstream in the sheet conveying direction when the sheet bundle is set while the sheet bundle is rotated by using the upper portion of the trailing end of the sheet bundle as a supporting point; therefore, when the sheet bundle is to be set in the attachment, it is possible to prevent the part of the sheet bundle close to the leading end from coming into contact with the protruding member that protrudes upstream in the feed direction from the downstream end portion of the feed tray in the sheet conveying direction, and it is possible to prevent reduction in the setting performance.

(Aspect 3)

In Aspect 2, the elastic deformable portion of the end fence is extended to a lower end of the end fence.

With this configuration, as described in the first modification, the sheet placing board, such as the bottom plate 1105, rotates with the upstream side in the conveying direction as a supporting point as the number of sheets in the sheet bundle decreases. The attachment 200 is attached to the sheet placing board, so that the attachment 200 also rotates together with the sheet placing board with the upstream side in the conveying direction as a supporting point. In this manner, with rotation of the attachment 200 together with the sheet placing board, the position of the end fence of the attachment 200 in the feed direction is displaced due to the rotation of the sheet placing board. As a result, positions of leading ends of the stacked sheets vary between when the sheet bundle contains a large number of sheets and when the sheet bundle contains a small number of sheets, so that it may become difficult to appropriately convey the stacked sheet until the end. However, by extending the elastic deformable portion of the end fence to the lower end of the end fence, it becomes possible to push even a last stacked sheet downstream in the conveying direction with the aid of a restoring force of the elastic deformable portion of the end fence. Therefore, it is possible to locate leading end positions of all of sheets including the last sheet in the sheet bundle to a specific position with the aid of the restoring force of the elastic deformable portion. Consequently, it is possible to appropriately convey all of sheets including the last sheet in the sheet bundle.

(Aspect 4)

In any of Aspects 1 to 3, the end fence, such as the small size end fence 201, includes an eaves-shaped portion, such as the eaves portion 231*c*.

With this configuration, as described in the first modification, it is possible to cause the eaves-shaped portion to face the part of a top sheet of the set sheet bundle close to the trailing end. Consequently, it is possible to prevent the part of the set sheet bundle close to the trailing end from floating by using the eaves-shaped portion, so that it is possible to prevent sheets in the set sheet bundle from coming off.

(Aspect 5)

In Aspect 4, the eaves-shaped portion, such as the eaves portion 231*c*, is disposed in the elastic deformable portion, such as the elastic deformable member 230, of the end fence, that is elastically deformable in the sheet conveying direction, such as the small size end fence 201.

With this configuration, as described above with reference to FIGS. 13A to 13D, when the sheet bundle is to be set, and if the top surface of the sheet bundle comes into contact with an edge of the eaves-shaped portion, the elastic deformable portion is elastically deformed, so that it is possible to prevent an increase in the sliding resistance between the eaves-shaped portion and the top surface of the sheet bundle. Therefore, a defect in which the eaves-shaped portion causes the uppermost sheet of the sheet bundle to be twisted is less likely to occur. Consequently, it is not necessary to set the sheet bundle in a laid manner in the attachment 200 to prevent the top surface of the sheet bundle from coming into contact with the eaves-shaped portion, and it is possible to easily set the sheet bundle in the attachment 200.

(Aspect 6)

In any of Aspects 1 to 5, the stacking part 203 that includes a recess on a sheet stacking surface, such as the stacking surface 203*a*, is included, and the ribs 206 are disposed in the recess.

With this configuration, as described above in the aspect, when the upper trailing end portion of the sheet bundle is brought into contact with the end fence, such as the small size end fence, of the attachment while causing the part of the sheet bundle close to the trailing end to slide on the surface of the stacking part 203, it is possible to guide the trailing end by the ribs 206. Consequently, when the part of the sheet bundle close to the trailing end is moved upstream in the conveying direction while causing the part close to the trailing end to slide on the surface of the stacking part 203, it is possible to prevent the trailing end of the lowermost sheet of the sheet bundle from being folded or the like.

(Aspect 7)

In any of Aspects 1 to 6, a weight is attached to the attachment.

With this configuration, as described in the second modification, even if the sheet bundle to be set has a small size and small weight, it is possible to convey sheets that are stacked at appropriate sheet feed pressure.

(Aspect 8)

In a feed device that includes a feed tray, such as the sheet cassette 11, including a sheet stacking board, such as the bottom plate 1105, and including the attachment 200 attachable to and detachable from the sheet stacking board, and that feeds a sheet set in the feed tray, as the attachment, the attachment in any of Aspects 1 to 7 is used.

With this configuration, it is possible to prevent reduction in the strength of the bottom plate, and it is possible to appropriately feed a sheet with the special small size.

(Aspect 9)

In a feed device that includes a feed tray, such as the sheet cassette 11, including a sheet stacking board, such as the bottom plate 1105, and including the attachment attachable to and detachable from the sheet stacking board, and that feeds a sheet set in the feed tray, the attachment includes an end fence, such as the small size end fence 201, for restricting a position of a trailing end of a sheet in a sheet conveying direction, and a position of the sheet in a width direction, the sheet being stacked on the sheet stacking board to which the attachment 200 is attached, is restricted by the side fences 1101 and 1102 disposed in the feed tray.

With this configuration, as described above in the aspect, it is possible to evacuate the side fences 1101 and 1102 when the sheet bundle is to be set, so that it is possible to easily set the sheet bundle in the sheet stacking board to which the attachment is attached.

(Aspect 10)

In an image forming apparatus that includes a feed device for feeding a sheet, and forms an image on a sheet that is fed by the feed device, as the feed device, the feed device described in Aspect 8 or 9 is used.

With this configuration, it is possible to appropriately feed a sheet with the special small size.

According to an embodiment, it is possible to prevent reduction in setting performance.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. An attachment attachable to and detachable from a sheet stacking board, the attachment comprising:

an end fence configured to restrict a position of a trailing end of a sheet in a conveying direction, wherein the end fence includes a facing surface facing the trailing end of the sheet, the facing surface comprising an inclined surface inclined with respect to a vertical direction of a stacking surface on which the sheet is stacked, such that a higher part of the facing surface is located more upstream in the sheet conveying direction, wherein the end fence includes an eaves-shaped portion, and wherein the eaves-shaped portion is disposed in an elastic deformable portion of the end fence, the elastic deformable portion being elastically deformable in the sheet conveying direction.

2. The attachment according to claim 1, wherein the end fence includes an elastic deformable portion elastically deformable in the sheet the conveying direction.

3. The attachment according to claim 2, wherein the elastic deformable portion of the end fence extends to a lower end of the end fence.

4. The attachment according to claim 1, further comprising:

a stacking part having a recess on a sheet stacking surface, wherein a rib is disposed in the recess.

5. The attachment according to claim 1, wherein a weight is attached to the attachment.

6. A feed device comprising:

a feed tray including:

a sheet stacking board; and an attachment attachable to and detachable from the sheet stacking board, the feed device being configured to feed a sheet set in the feed tray, wherein as the attachment, the attachment according to claim 1 is used.

7. An image forming apparatus comprising:

a feed device configured to feed a sheet, the image forming apparatus being configured to form an image fed by the feed device, wherein as the feed device, the feed device according to claim 6 is used.

8. A feed device comprising:

a feed tray including:

a sheet stacking board; and an attachment attachable to and detachable from the sheet stacking board, the feed device being configured to feed a sheet set in the feed tray, wherein the attachment includes an end fence configured to restrict a position of a trailing end of a sheet in a sheet conveying direction, and a position of the sheet in a width direction, the sheet being stacked on the sheet stacking board to which the attachment is attached, is restricted by a side fence disposed in the feed tray, wherein the end fence includes an eaves-shaped portion, and wherein the eaves-shaped portion is disposed in an elastic deformable portion of the end fence, the elastic deformable portion being elastically deformable in the sheet conveying direction.

9. An image forming apparatus comprising:

a feed device configured to feed a sheet, the image forming apparatus being configured to form an image fed by the feed device, wherein as the feed device, the feed device according to claim 8 is used.

* * * * *